US009169820B2

(12) United States Patent
Yamada et al.

(10) Patent No.: US 9,169,820 B2
(45) Date of Patent: Oct. 27, 2015

(54) IGNITION SYSTEM

(75) Inventors: Tatsunori Yamada, Seto (JP); Kohei Katsuraya, Nagoya (JP); Katsutoshi Nakayama, Nagoya (JP)

(73) Assignee: NGK Spark Plug Co., Ltd., Aichi (JP)

( * ) Notice: Subject to any disclaimer, the term of this patent is extended or adjusted under 35 U.S.C. 154(b) by 845 days.

(21) Appl. No.: 13/444,092

(22) Filed: Apr. 11, 2012

(65) Prior Publication Data

US 2012/0260899 A1 Oct. 18, 2012

(30) Foreign Application Priority Data

Apr. 12, 2011 (JP) ..... 2011-087911

(51) Int. Cl.

| | |
|---|---|
| ***F02P 3/02*** | (2006.01) |
| ***F02P 9/00*** | (2006.01) |
| ***F02P 15/10*** | (2006.01) |
| ***F02P 3/04*** | (2006.01) |
| ***F02P 23/04*** | (2006.01) |
| ***H01T 13/04*** | (2006.01) |
| ***H01T 13/06*** | (2006.01) |

(52) U.S. Cl.

CPC . *F02P 9/007* (2013.01); *F02P 3/02* (2013.01); *F02P 3/04* (2013.01); *F02P 15/10* (2013.01); *F02P 23/04* (2013.01); *H01T 13/04* (2013.01); *H01T 13/06* (2013.01)

(58) Field of Classification Search

CPC ..... F02P 3/02; F02P 9/007; F02P 13/00; F02P 15/10; F02P 15/12

See application file for complete search history.

(56) References Cited

U.S. PATENT DOCUMENTS 6,111,345 A * 8/2000 Shibata et al. ..... 313/141
6,545,415 B1 * 4/2003 Ward ..... 315/56

(Continued)

FOREIGN PATENT DOCUMENTS

JP 52-170133 12/1977 ..... F02P 3/04
JP 8-97079 4/1996 ..... H01G 4/30

(Continued)

OTHER PUBLICATIONS

Notification of Reasons for Refusal (dated Apr. 23, 2013) issued in connection with corresponding Japanese Patent Application No. 2011-087911, with English translation.

(Continued)

*Primary Examiner* — Erick Solis
(74) *Attorney, Agent, or Firm* — Kusner & Jaffe

(57) ABSTRACT

An ignition system wherein creation of misfires is suppressed and excellent ignition ability is realized. The ignition system includes a spark plug; a discharge power source applying a voltage in order to generate a spark discharge at the spark plug; an AC power source supplying AC power to a spark generated by the spark discharge; and an ignition cable electrically connecting the spark plug, the discharge power source and the AC power source. The ignition cable includes a discharge electrode connecting the discharge power source and the spark plug, an AC electrode transmitting AC power from the AC power source to the spark plug, and an insulator interposed between the discharge and AC electrodes.

19 Claims, 11 Drawing Sheets

(56) References Cited

U.S. PATENT DOCUMENTS

| | | | | |
|---|---|---|---|---|
| 8,226,901 | B2 | 7/2012 | Makita et al. | 422/186.21 |
| 8,420,021 | B2 | 4/2013 | Makita et al. | 422/186.21 |
| 8,820,293 | B1 * | 9/2014 | McAlister | 123/297 |
| 8,861,173 | B2 | 10/2014 | Ikeda et al. | 361/253 |
| 2002/0101701 | A1 * | 8/2002 | Moga et al. | 361/247 |
| 2004/0129241 | A1 | 7/2004 | Freen | 123/143 |
| 2010/0196208 | A1 | 8/2010 | Makita et al. | 422/83 |
| 2012/0212313 | A1 * | 8/2012 | Burrows | 336/90 |
| 2012/0258016 | A1 | 10/2012 | Makita et al. | 422/186.04 |
| 2012/0260898 | A1 * | 10/2012 | Schremmer | 123/598 |
| 2014/0137840 | A1 * | 5/2014 | McAlister | 123/445 |

FOREIGN PATENT DOCUMENTS

| | | | |
|---|---|---|---|
| JP | 8-298225 | 11/1996 | H01G 4/12 |
| JP | 2009-008100 | 1/2009 | F02C 7/266 |
| JP | 2009-036198 | 2/2009 | F02P 23/04 |
| WO | WO2011/016569 | 2/2011 | F02P 23/04 |

OTHER PUBLICATIONS

Korean Office Action issued in connection with corresponding Korean Patent Application.

* cited by examiner

IGNITION SYSTEM

FIELD OF THE INVENTION

The present invention relates to an ignition system of an internal combustion engine or the like.

BACKGROUND OF THE INVENTION

In the related art, as an ignition system used in a combustion device of an internal combustion engine, a device, which includes a spark plug having a center electrode and a ground electrode, and forms a gap between both electrodes, a discharge power source such as an ignition coil supplying a voltage to the spark plug, and an ignition cable electrically connecting the spark plug and the discharge electrode, is known. In the above described ignition device, a high voltage is applied from the discharge power source to the spark plug via the ignition cable so that a spark discharge is generated in the gap of the spark plug. As a result, the fuel gas is ignited.

In recent years, a technique has been disclosed in which in order to improve an ignition ability, the spark discharge is generated by an AC power (a high frequency power) input from an AC power source to the gap, instead of the high voltage (for example, see JP-A-2009-8100).

Problem that the Invention is to Solve

However, in the above described technique, since the spark is only generated by the AC power, the voltage required by the conditions inside of a combustion chamber cannot be output. Accordingly, a situation that the spark discharge is not created (a so-called misfire) may easily occur irrespective of inputting of the power.

Meanwhile, in order to prevent the creation of a misfire, it can be considered that an increase in the AC power would more reliably output the required voltage. However, for example, in order to increase the output, the AC power needs to be increased to the second power and then the situation cannot be improved, only made less efficient. Furthermore, there is concern that the center electrode or the ground electrode is easily worn due to the increase in power.

The invention is accomplished considering the above described situation and an object of the invention is to provide an ignition system which can suppress creation of misfires and can realize excellent ignition ability.

SUMMARY OF THE INVENTION

Means for Solving the Problem

Hereinafter, each arrangement suitable to solve the above described problems will be described by dividing each article. In addition, a specific effect corresponding to each arrangement is added where necessary.

Arrangement 1.

An ignition system comprising:

a spark plug;

a discharge power source applying a voltage in order to generate a spark discharge at the spark plug;

an AC power source supplying AC power to a spark generated by the spark discharge; and an ignition cable electrically connecting the spark plug, the discharge power source and the AC power source, wherein the ignition cable includes, a discharge electrode connecting the discharge power source and the spark plug in order to apply the voltage from the discharge power source to the spark plug, an AC electrode transmitting the AC power from the AC power source to the spark plug side, an insulator interposed between both electrodes, and a cylindrical shaped second insulator, wherein at least a portion of the second insulator is arranged at an outer circumference of the discharge electrode, the AC electrode and the insulator, and wherein a permittivity of the insulator is larger than a permittivity of the second insulator.

According to the first arrangement, the invention is configured such that the spark is generated at the spark plug by the voltage supplied from the discharge power source and then AC power is input from the AC power source to the spark. Accordingly, the spark is strengthened by the AC power so that the spark can be further developed in size. As a result, the ignition ability can be significantly improved.

In addition, since the spark is generated by the applying of the voltage, as a case where only the AC power is input and the spark is generated, the situation where the required voltage cannot output is unlikely to occur and the misfire can be reliably prevented from occurring.

Meanwhile, there is concern that when both the voltage for spark discharge and the AC power is input to the spark plug, the current flows from the discharge power source to the AC power source and then sufficient voltage cannot be applied to the spark plug. At this point, according to the first arrangement, the ignition cable, which electrically connects the spark plug, the discharge power source and the AC power source, includes the discharge electrode, the AC electrode and the insulator interposed between both electrodes, and the capacitor formed of both electrodes and the insulator is interposed between the spark plug and the AC power source. Accordingly, the AC power, where the oscillation frequency is relatively high, passes the capacitor and is input to the spark plug, while the current output from the discharge power source has a relatively low frequency, and is suppressed from flowing into the AC power source by the presence of the capacitor. Thus, sufficient voltage can be input to the spark plug and the spark can be more reliably generated. As a result, the above described effect of improvement of the ignition ability can be more reliably exhibited.

In addition, the flow of the current from the AC power source to the discharge power source may be considered. However, generally the discharge power source to generate the spark includes for example, a coil such as an ignition coil. Accordingly, the flow of the current from the AC power source to the discharge power source is prevented by the presence of the coil having a characteristic that cuts high frequency and transmits low frequency.

Arrangement 2.

In the arrangement 1, an oscillation frequency of the AC power is equal to or more than 50 kHz and equal to or less than 100 MHz, when a capacitance of a capacitor formed of the discharge electrode, the AC electrode and the insulator is C (F), and the oscillation frequency of the AC power is f (Hz), $C \geq 0.0005$ (F·Hz)/f is satisfied.

According to the second arrangement, the oscillation frequency of the AC power is sufficiently low, equal to or less than 100 MHz. Accordingly, for example, in a case where the oscillation frequency of the AC power is significantly increased, the wavelength of the AC power is extremely short. As a result, there is concern that resonance may occur inside the ignition cable or the spark plug, and impede the input of the AC power. According to the second arrangement, the wavelength of the AC power can be sufficiently increased and the above described concern can be dispelled. In other words, according to the second arrangement, the occurrence of resonance inside the ignition cable or the spark plug can be more reliably prevented and the above described effect of the improvement of the ignition ability can be more reliably exhibited. In addition, since the occurrence of resonance can be prevented without adjusting the design of the spark plug or the like in detail, design freedom of the spark plug or the like can be sufficiently secured. Furthermore, the spark plug which is generally used in the related art, can be used as it is, without any specific adjustment.

According to the second arrangement, the capacitance C (F) of the capacitor is set to satisfy $C \geq 0.0005$ (F·Hz)/f with respect to the oscillation frequency f (Hz). Accordingly, when the AC power passes the capacitor, the loss of the AC power is decreased and the ignition ability can be further improved.

Arrangement 3.

In the arrangement of 1 or 2, the insulator is formed of a composite material of a ceramic, and a resin or a rubber.

According to the third arrangement, the insulator is formed of a composite material of ceramic, resin or rubber. Accordingly, the resin or the rubber functions as a shock absorber against mechanical impact or thermal impact, and exfoliation of the ceramic from the discharge electrode or the AC electrode due to impact can be more reliably prevented. As a result, the durability of the capacitor can be further increased and the excellent ignition ability can be maintained over a longer period.

Furthermore, by disposing the resin or the rubber, the flexibility of the ignition cable can be increased and the ignition cable can be more easily handled.

Arrangement 4.

In the arrangement of any one of 1 to 3, the ignition cable is configured, such that the cylindrical shaped AC electrode is arranged at an inner circumference of the second insulator; the cylindrical shaped insulator is arranged at an inner circumference of the AC electrode; the discharge electrode is arranged at an inner circumference of the insulator; and an end of the discharge electrode to the spark plug side is connected to the spark plug.

According to the fourth arrangement, basically, the same effect as the first arrangement is achieved.

In addition, according to the fourth arrangement, the permittivity of the insulator configuring a portion of the capacitor is larger than the permittivity of the second insulator arranged at the outer circumference of the capacitor. Accordingly, the situation where the AC power input to the capacitor (the AC electrode) is transmitted to the low potential side such as the engine on which the spark plug is mounted via the second insulator, can be more reliably prevented. As a result, the loss of AC power can be more reliably decreased at the time of transmitting and the spark can be more effectively developed.

Arrangement 5.

In the arrangement of any one of 1 to 3, the ignition cable is configured, such that the discharge electrode, at least a portion thereof being cylindrical, is arranged at the inner circumference of the second insulator; the cylindrical insulator is arranged at an inner circumference of the cylindrical portion of the discharge electrode; the AC electrode is arranged at the inner circumference of the insulator; and an end of the discharge electrode to the spark plug side is connected to the spark plug.

According to the fifth arrangement, basically, the same effect as the fourth arrangement is achieved.

Arrangement 6.

In the arrangement of any one of 1 to 3, the ignition cable is configured, such that at least of a portion of the discharge electrode is plane-shaped; a portion of the AC electrode which faces at least the plane-shaped portion of the discharge electrode is plane-shaped; the insulator is arranged between the plane-shaped portion of the discharge electrode and the plane-shaped portion of the AC electrode; both electrodes and the insulator are arranged at the inner circumference of the second insulator; and an end of the discharge electrode to the spark plug side is connected to the spark plug.

According to the sixth arrangement, basically, the same effect as the fourth arrangement is achieved.

Arrangement 7.

In the arrangement of any one of 1 to 3, the ignition cable is configured, such that at least a portion of the discharge electrode is spiral-shaped at a cross-section orthogonal to a longitudinal direction thereof; a portion of the AC electrode which faces at least the spiral-shaped portion of the discharge electrode is spiral-shaped; the insulator is arranged between the spiral-shaped portion of the discharge electrode and the spiral-shaped portion of the AC electrode; the discharge electrode, the AC electrode and the insulator are arranged at the inner circumference of the second insulator; and an end of the discharge electrode to the spark plug side is connected to the spark plug.

According to the seventh arrangement, basically, the same effect as the fourth arrangement is achieved.

Arrangement 8.

In the arrangement of any one of 1 to 3, the ignition cable is configured, such that the discharge electrode includes a first main electrode plate extending along the longitudinal direction thereof and a plurality of first auxiliary electrode plates extending from the first main electrode plate and lined up along a direction orthogonal to the longitudinal direction; the AC electrode includes a second main electrode plate extending along the longitudinal direction thereof and a plurality of second auxiliary electrode plates extending from the second main electrode plate and lined up along a direction orthogonal to the longitudinal direction; the discharge electrode and the AC electrode are arranged so that the first main electrode plate and the second main electrode plate face each other, and the first auxiliary electrode plates and the second auxiliary electrode plates are lined up alternately; the insulator is arranged between both auxiliary electrode plates; the discharge electrode, the AC electrode and the insulator are arranged at the inner circumference of the second insulator; and the end of the discharge electrode to the spark plug side is connected to the spark plug.

According to the eighth arrangement, basically, the same effect as the fourth arrangement is achieved.

Arrangement 9.

In the arrangement of 1 or 2, the insulator is formed of ceramic.

According to the ninth arrangement, since the insulator is formed of the ceramic that is excellent in the heat resistance and voltage resistance, the durability of the capacitor can be increased. As a result, excellent ignition ability can be maintained for a longer period.

Arrangement 10.

In the arrangement of 3 or 9, the ceramic has barium titanate as a main component.

According to the tenth arrangement, $BaTiO_3$, a ceramic that is superior in heat resistance, is used as the ceramic configuring the insulator. Accordingly, the durability of the capacitor can be further increased and the excellent ignition ability can be maintained for a longer period.

In addition, since BaTiO3 has extremely high permittivity, the capacitance of the capacitor can be further increased. Thus, when the AC power transmits the capacitor, the permittivity of the AC power can be further improved and the ignition ability can be further improved.

Arrangement 11.

In the arrangement of any one of 1 to 10, at least portions of the discharge electrode and the AC electrode that face each other by interposing the insulator have a volume resistivity equal to or less than 0.1 μΩ·m and are formed of a non-magnetic metallic material.

According to the eleventh arrangement, the loss of the AC power can be further decreased and the AC power input to the spark can be further increased at the time of transmitting. As a result, the ignition ability can be further improved.

Arrangement 12.

In the arrangement of 11, the metallic material is copper, silver, gold, aluminum, zinc or an alloy of which any one of the foregoing is a main component.

According to the twelfth arrangement, the portions of the electrodes forming the capacitor, which face each other by interposing the insulator, are formed of the metallic material of which the volume resistivity is extremely small, such as Cu or Ag. Thus, the loss of the AC power can be more effectively prevented and the ignition ability can be further improved.

Arrangement 13.

An ignition system comprising:

a spark plug;

a discharge power source applying a voltage in order to generate a spark discharge at the spark plug;

an AC power source supplying the AC power to a spark generated by the spark discharge; and an ignition cable electrically connecting the spark plug, the discharge power source and the AC power source, wherein the spark plug has an insulator having a shaft hole extending in an axial direction, a plug electrode arranged inside the shaft hole and in which a voltage is applied from the discharge power source and a main metal fitting arranged at an outer circumference of the insulator, wherein the ignition cable includes, a discharge electrode transmitting the voltage from the discharge power source, and an AC electrode arranged at an outer circumference of the discharge electrode and supplying the AC power from the AC power source to the spark plug, and wherein in a state where the ignition cable is connected to the spark plug, an end of the discharge electrode to the spark plug side is connected to the plug electrode, an end of the AC electrode to the spark plug side is arranged at the outer circumference of the insulator so as to interpose the insulator with the plug electrode, and the shortest distance between the AC electrode and the main metal fitting along the surface of the insulator, and the shortest distance between the AC electrode and the plug electrode along the surface of the insulator are equal to or more than 5 mm respectively.

According to the thirteenth arrangement, basically, the same effect as the first arrangement is achieved.

In addition, according to the thirteenth arrangement, since the capacitor is configured using the insulator which the spark plug generally has, the cost thereof can be more effectively decreased compared to the case where the capacitor is disposed at the ignition cable.

The shortest distance between the AC electrode and the main metal fitting along the surface of the insulator, and the shortest distance between the AC electrode and the plug electrode along the surface of the insulator, are equal to or more than 5 mm respectively. Thus, the leakage of the current between the AC electrode, the main metal fitting and the plug electrode can be more reliably prevented and the occurrence of the misfire can be more reliably suppressed.

Arrangement 14.

In the arrangement of 13, an oscillation frequency of the AC power is equal to or more than 50 kHz and equal to or less than 100 MHz, and when the capacitance of a capacitor formed by the plug electrode, the AC electrode and the insulator interposed between the plug electrode and the AC electrode is C (F), and the oscillation frequency of the AC power is f (Hz), $C \leq 0.0005$ (F·Hz)/f is satisfied.

According to the fourteenth arrangement, basically, the same effect as the second arrangement is achieved.

Arrangement 15.

In the arrangement of 13 or 14, in a state where the ignition cable is connected to the spark plug, a fastener, which can fasten the insulator in the radial direction, is disposed at the end of the AC electrode to the spark plug side.

According to the fifteenth arrangement, the insulator and the AC electrode can be more stably connected by the fastener disposed at the end of the AC electrode to the spark plug side. As a result, the capacitor can be more reliably formed by the plug electrode, the AC electrode and the insulator, and the above described effect can be more reliably exhibited.

Arrangement 16.

In the arrangement of any one of 13 to 15, the spark plug includes a conductive resistor on a transmission path of the voltage from the discharge power source. In a state where the ignition cable is connected to the spark plug, the capacitor, which is formed of the plug electrode, the AC electrode, and the insulator interposed between the plug electrode and the AC electrode, is formed at a tip side of the spark plug than the conductive resistor.

According to the sixteenth arrangement, since the spark plug includes a conductive resistor on the conductive path of the voltage from the discharge electrode, the radio noise due to the operation of the internal combustion engine or the like can be suppressed.

When the resistor is present on the conductive path of the AC power which connects between gaps of the AC power source and the spark plug, there is a concern that loss of AC power occurs in the resistor and the spark cannot be sufficiently strengthened.

At this point, according to the sixteenth arrangement, the capacitor is formed at the tip side of the spark plug than the resistor, and a joint portion of the conductive path of the high voltage and the conductive path of the AC power is positioned at the tip side of the spark plug than the resistor. In other words, the resistor is present only on the conductive path of the high voltage and is not present on the conductive path of the AC power. Thus, the loss of the AC power can be prevented by the resistor and the improvement of the ignition ability can be more reliably exhibited.

Arrangement 17.

In the arrangement of any one of claims 13 to 16, the insulator has barium titanate as a main component.

According to the seventeenth arrangement, basically, the same effect as the tenth arrangement is achieved.

Arrangement 18.

In the arrangement of any one of 13 to 17, at least portions of the plug electrode and the AC electrode that face each other by interposing the insulator have a volume resistivity equal to or less than 0.1 μΩ·m and are formed of a non-magnetic metallic material.

According to the eighteenth arrangement, basically, the same effect as the eleventh arrangement is achieved.

Arrangement 19.

In the arrangement of 18, the metallic material is copper, silver, gold, aluminum, zinc or an alloy of which a main component is any one of these.

According to the nineteenth arrangement, basically, the same effect as the twelfth arrangement is achieved.

BRIEF DESCRIPTION OF THE DRAWINGS

FIG. 2 is a partial cutaway front view illustrating a configuration of a spark plug or the like.

FIG. 3 is a schematic configuration view illustrating a configuration of an ignition cable or the like.

DETAILED DESCRIPTION OF THE INVENTION

Hereinafter, embodiments will be described with reference to drawings.

First Embodiment

Figure 1:
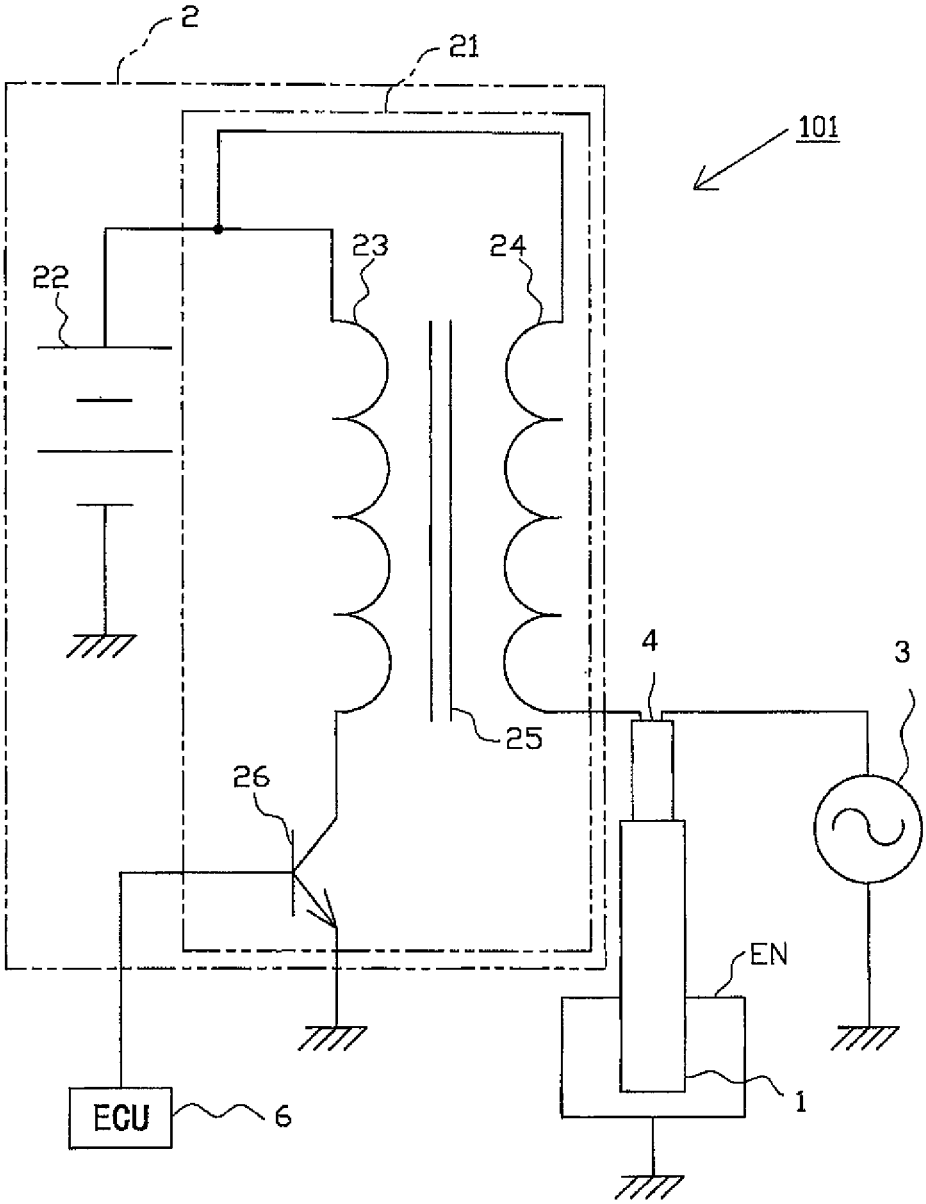
FIG. 1 is a block diagram illustrating a schematic configuration of an ignition system.

FIG. 1 is a block diagram of a schematic configuration of an ignition system 101. In addition, in FIG. 1, only a single spark plug 1 is illustrated, however, a plurality of cylinders are disposed in a practical engine EN and the spark plugs 1 are disposed corresponding to each of the cylinders. Thus, the power from a discharge power source 2 or an AC power source 3 described below is supplied to each spark plug 1 via a distributor (not shown).

The ignition system 101 includes the spark plug 1, the discharge power source 2, the AC power source 3, and an ignition cable 4.

Figure 2:
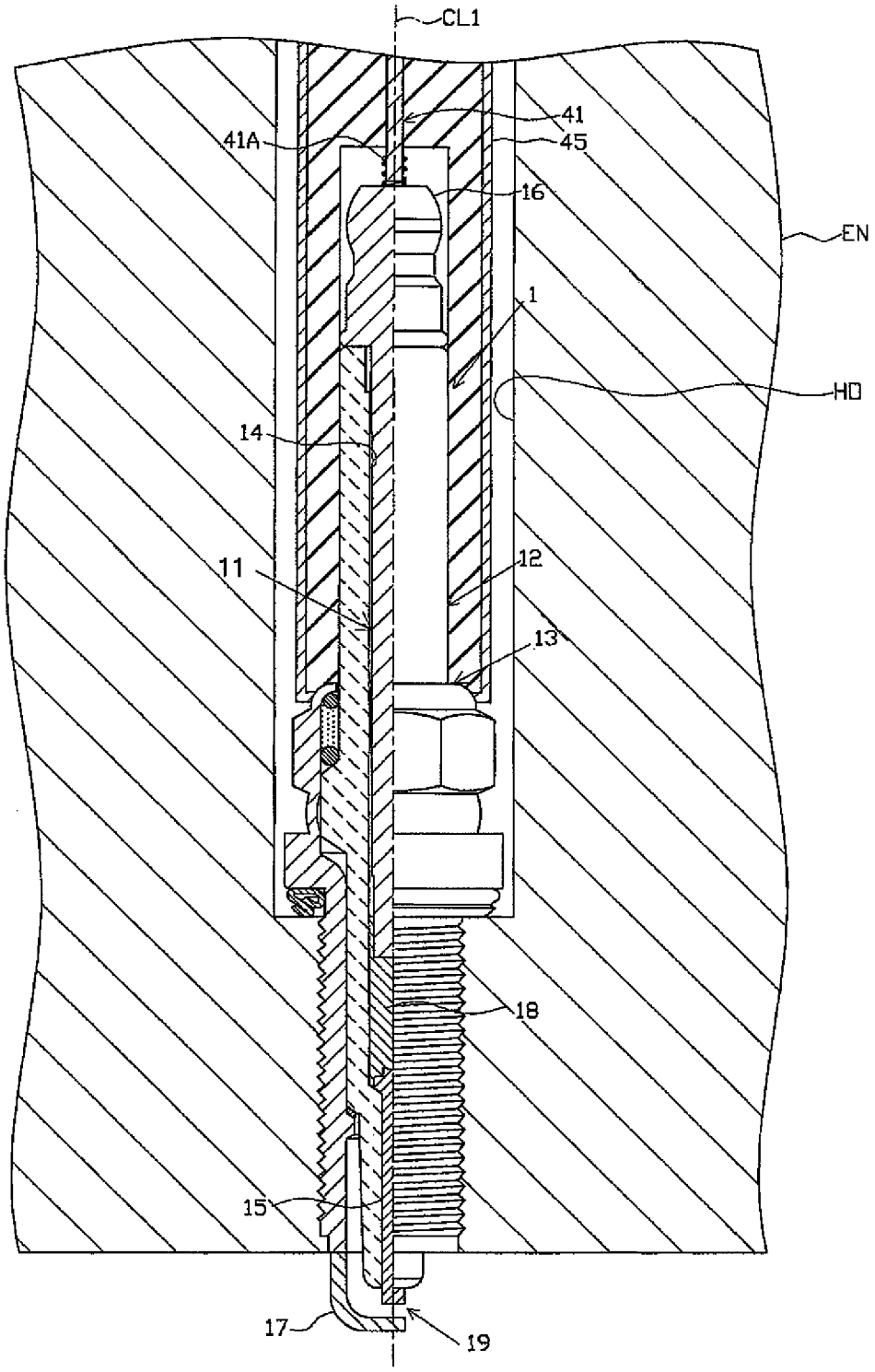

As shown in FIG. 2, the spark plug 1 includes a cylindrical porcelain insulator 12 having a shaft hole 14 extending in a direction of an axis CL1, a center electrode 15 and a terminal fitting 16 inserted into the shaft hole 14, a cylindrical shaped main metal fitting 13 arranged on an outer circumference of the porcelain insulator 12 and a ground electrode 17 fixed at a tip of the main metal fitting 13. Thus, the center electrode 15 and the terminal fitting 16 are fixed and electrically connected to the porcelain insulator 12 by a conductive glass seal layer 18, and a plug electrode 11 is formed where an electric current flows from the discharge power source 2 or the AC power source 3 by the center electrode 15, the terminal fitting 16 and a glass seal layer 18. In addition, a gap 19 is formed between a tip of the center electrode 15 and a tip of the ground electrode 17. In addition, the spark plug 1 is attached at a plug hole HO (a mounting hole) formed at the engine EN. As a result, the main metal fitting 13 contacts the engine EN and is in a grounded state.

Returning to FIG. 1, the discharge power source 2 includes an ignition coil 21 and a power supply battery 22 for supplying a high voltage to the spark plug 1 and for generating a spark discharge at the gap 19. In addition, the ignition coil 21 includes a primary coil 23, a secondary coil 24, a core 25 and an igniter 26.

The primary coil 23 is wound around the core 25, one end thereof is connected to the battery 22 and the other end is connected to the igniter 26. In addition, the secondary coil 24 is wound around the core 25, one end thereof is connected between the primary coil 23 and the secondary coil 24 and the other end thereof is electrically connected to the spark plug 1 via the ignition cable 4.

Moreover, the igniter 26 is formed of a predetermined transistor and switches the supply and the supply stop of the power from the battery 22 to the primary coil 23 according to a turn-on signal that is input from an electronic control unit (ECU) 6 of a vehicle. If the high voltage is applied to the spark plug 1, the electric current flows from the battery 22 to the primary coil 23, a magnetic field forms inside the core 25 and the turn-on signal from the ECU 6 is switched from ON to OFF so that the flow of the electric current is stopped from the battery 22 to the primary coil 23. According to the stoppage of the current, the magnetic field of the core 25 changes, a first voltage is generated at the primary coil 23 by a self-induction effect and the high voltage (on the order of ones to tens of kVs) having a negative polarity and a relatively low frequency generates at the secondary coil 24. The high voltage having the negative polarity is applied to the spark plug 1 so that the spark discharge generates at the gap 19 of the spark plug 1.

The AC power source 3 supplies the AC power to the spark plug 1 via an AC electrode 42 of the ignition cable 4 as described below. In the embodiment, an oscillation frequency of the AC power supplied from the AC power source 3 is set equal to or more than 50 kHz and equal to or less than 100 MHz (for example, between 13 MHz and 42 MHz).

Figure 3:
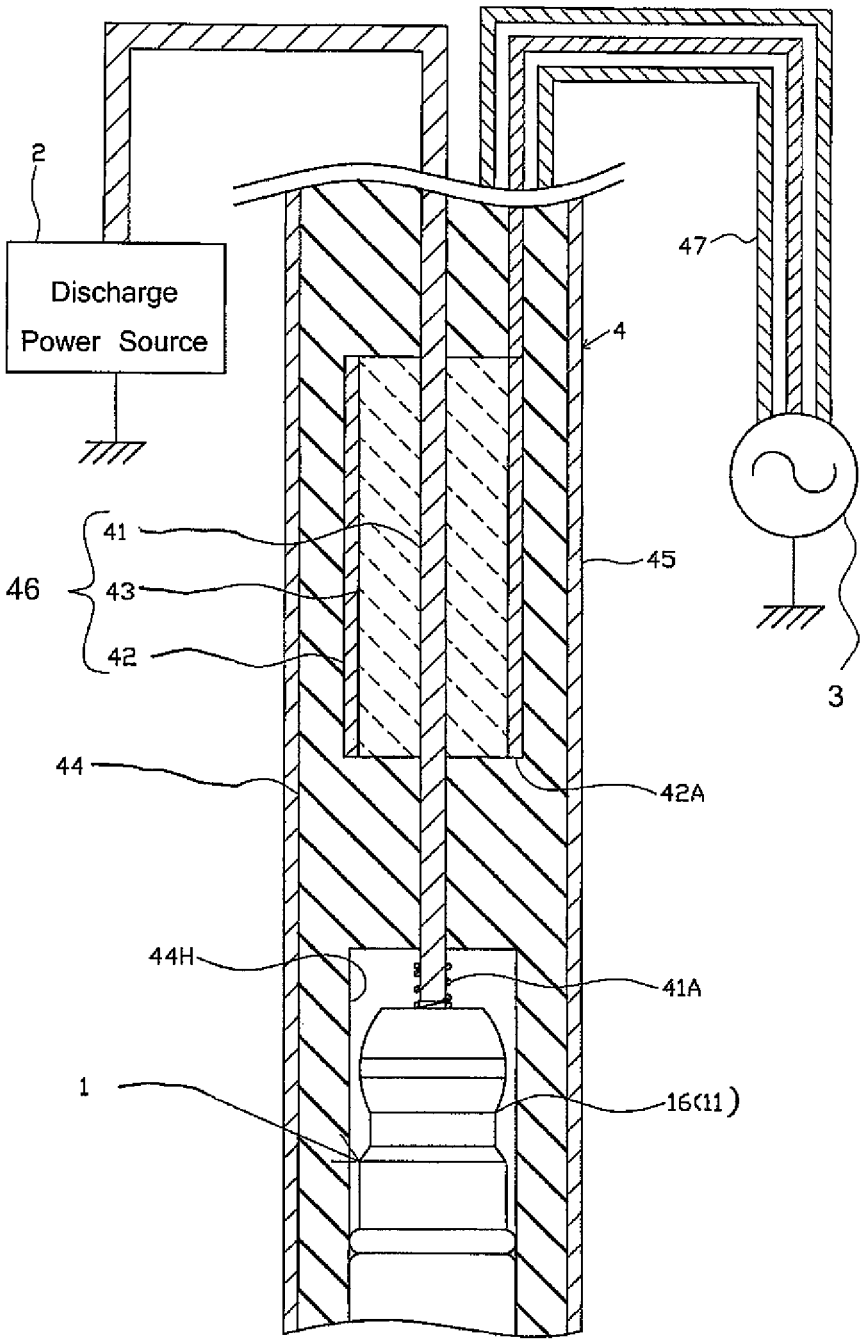

Moreover, the ignition cable 4 electrically connects the spark plug 1, the discharge power source 2 and the AC power source 3. As shown in FIG. 3, ignition cable 4 includes a discharge electrode 41, an AC electrode 42, an insulator 43 and a second insulator 44 and a shield member 45.

The discharge electrode 41 electrically connects the secondary coil 24 of the discharge power source 2 and the terminal fitting 16 of the spark plug 1, and transmits the high voltage generated in the discharge power source 2 (the secondary coil 24) to the spark plug 1. In the embodiment, a volume resistivity of the discharge electrode 41 is equal to or less than 0.1 μΩ·m and is formed of the non-magnetic material. In addition, copper (Cu), silver (Ag), gold (Au), aluminum (Al), zinc (Zn) or an alloy having any one of the foregoing as a main component thereof, is used as the metallic material.

An end 41A of the discharge electrode 41 to the spark plug side is positioned to the spark plug 1 rather than an end 42A of the AC electrode 42 to the spark plug side. In a case where the ignition cable 4 is connected to the spark plug 1, the end 41A thereof to the spark plug is configured so as to contact with the terminal fitting 16. In addition, the end 41A thereof to the spark plug is spring-shaped and a stable contact is achieved by the discharge electrode 41 and the terminal fitting 16.

The AC electrode 42 is electrically connected to the AC power source 3, and becomes a transmission path of the AC power when the AC power is transmitted from the AC power source 3 to the spark plug 1. In the embodiment, the AC electrode 42 is formed of a plain-woven conductive wire (a conductive wire woven into a plane-shape) excellent in durability against bending and twisting in a cylindrical shape, and arranged at the outer circumference of the discharge electrode 41 so that its inner circumference faces the outer circumference of the discharge electrode 41. In addition, similar to the discharge electrode 41, the AC electrode 42 is equal to or less than 0.1 μΩ·m and is formed of the non-magnetic material.

Figure 4:
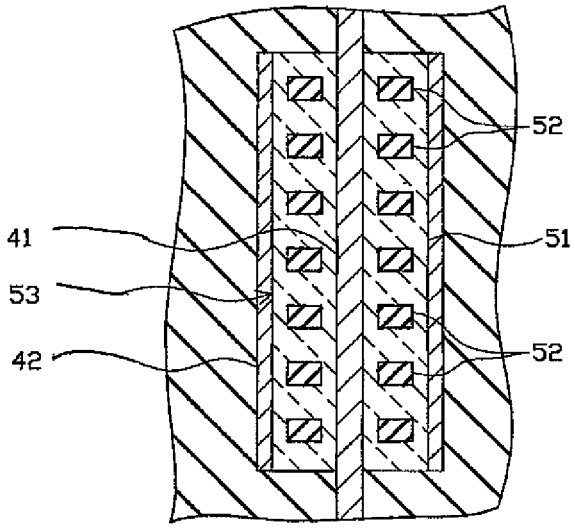
FIG. 4 is a partially enlarged cross-sectional view illustrating another example of an insulator.
Figure 5:
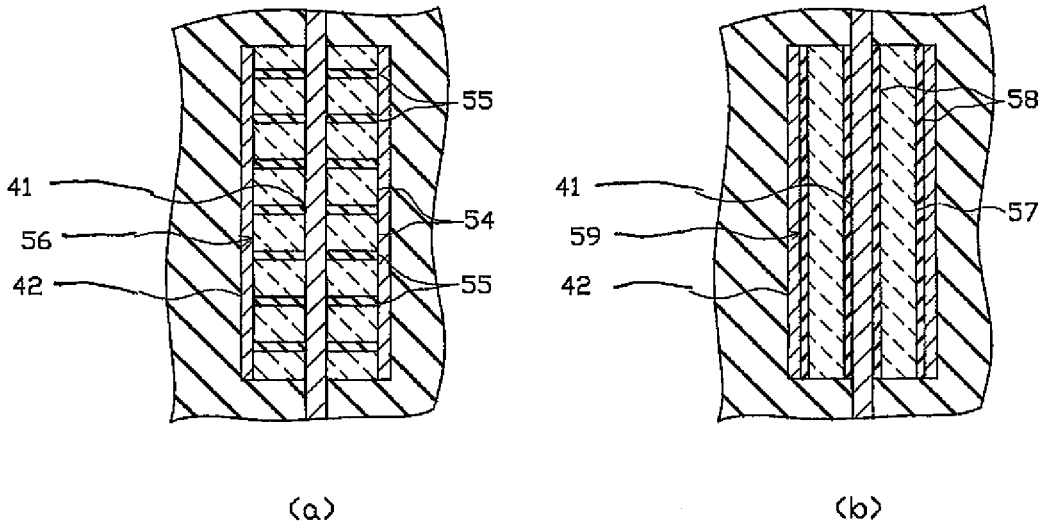
FIGS. 5*a* and 5*b* are partially enlarged cross-sectional views illustrating another example of an insulator.

The cylindrical shaped insulator 43 is arranged between the discharge electrode 41 and the AC electrode 42. In addition, the insulator 43 is formed of the insulation ceramic and in the embodiment, barium titanate ($BaTiO_3$) is used as the insulation ceramic. Moreover, the insulator 43 may be formed using other ceramics (for example, $PbTiO_3$, $Al_2O_3$ or the like), heat resistant resin or the like. In addition, as shown in FIG. 4, the insulator is not formed of a single ceramic but an insulator 53 may be configured of a ceramic 51 and a rubber 52 (for example, a silicon rubber, fluoro rubber or the like) or a plurality of ring-shaped resins (for example, epoxy resin or the like) which are disposed inside the ceramic 51 and arranged intermittently via a ceramic 51. In addition, the insulator 53 can be obtained by forming a pipe member where a circular ring member made of the ceramic and a similar circular pipe member made of the resin or the rubber are alternately laminated, and then disposing a cylindrical member made of the ceramic at the inner circumference and the outer circumference of the pipe member. In addition, in a case where the insulator is formed of the ceramic, and the resin or the rubber, the shape of the insulator is not specifically limited. Accordingly, for example, as shown in FIG. 5(*a*), an insulator 56 may be used which is formed by a ring-shaped ceramic 54 and a ring-shaped resin or a rubber 55 which are alternately laminated, and as shown in FIG. 5(*b*), an insulator 59 may be used which is formed by a cylindrical shaped resin or a rubber 58 disposed between a cylindrical shaped ceramic 57, the discharge electrode 41 and the AC electrode 42.

Returning to FIG. 3, the column-shaped capacitor 46 is formed of the above described discharge electrode 41, the AC electrode 42, and the insulator 43 interposed between both electrodes 41 and 42. In the embodiment, as described above, the oscillation frequency of the AC power supplied from the AC power source 3 is set equal to or more than 50 kHz and equal to or less than 100 MHz, and a capacitance of the capacitor 46 is set corresponding to the oscillation frequency. In other words, the capacitance of the capacitor 46 is set to satisfy $C \leq 0.0005$ (F·Hz)/f, wherein C (F) is the capacitance of the capacitor 46 and f (Hz) is the oscillation frequency of the AC power.

The second insulator 44 is disposed inside the shield member 45 and at least a portion of the second insulator 44 is located at the outer circumference of the AC electrode 42. In addition, the second insulator 44 includes a mounting hole 44H in which the porcelain insulator 12 and the terminal fitting 16 of the spark plug 1 are inserted when the ignition cable 4 is connected to the spark plug 1. Furthermore, the second insulator 44 is configured of a predetermined insulation material (for example, resin, rubber or the like) having a relatively small permittivity and plasticity. Thus, the permittivity of the insulator 43 is larger than the permittivity of the second insulator 44.

The shield member 45 is formed of the cylindrical shaped plain-woven conductive wire and is disposed at the outer circumference of the second insulator 44. In addition, the end of the shield member 45 to the spark plug 1 side is connected with a rear end of the main metal fitting 13 that is in a grounded state by contacting the engine EN and consequently the shield member 45 is in a grounded state (see FIG. 2). Moreover, in the embodiment, the shield member 45 or a cylindrical shaped external conductor 47 which is in a grounded state by electrically connecting to the shield member 45 is disposed at the outer circumference of the conductive path of the AC power to the spark plug 1. Thus, in the conductive path of the AC power, reflection of the power or radiation of electromagnetic noise to the outside is prevented, and the AC power can be reliably supplied to the spark plug 1.

As described above, according to the embodiment, the spark is generated at the spark plug 1 by the voltage supplied from the discharge power source 2 and then the AC power is input from the AC power source 3 to the spark. Accordingly, the spark strengthens by the AC power so that the spark can be developed in size and as a result, the ignition ability can be improved dramatically.

In addition, since the spark is generated by applying the voltage, a situation wherein the required voltage cannot be output in a case where the spark is generated by inputting only the AC power is unlikely to occur and the occurrence of a misfire can reliably be prevented.

Furthermore, the ignition cable 4 includes the discharge electrode 41, the AC electrode 42, and the insulator 43 interposed between both electrodes 41 and 42. The capacitor 46, which is formed of both electrodes 41 and 42, and the insulator 43 is inserted between the spark plug 1 and the AC power source 3. Accordingly, the AC power having a relatively high frequency such as equal to or more than 50 kHz is transmitted to the capacitor 46 and then input to the spark plug 1 while the current having a relatively low frequency output from the discharge power source 2 is suppressed to flow in the AC power source 3 by the presence of the capacitor 46. Thus, sufficient voltage can be input to the spark plug 1 and the spark can be reliably generated. In addition, the flow of the AC power into the discharge power source 2 can be prevented by the presence of the ignition coil 21. As a result, the effect of improving the ignition ability as described above can be exhibited more reliably.

Additionally, according to the embodiment, the oscillation frequency of the AC power can be sufficiently decreased to equal to or less than 100 MHz. Accordingly, the wavelength of the AC power can be sufficiently large and the occurrence of resonance can be prevented more reliably inside the ignition cable 4 or the spark plug 1, and the effect of improving the ignition ability can be exhibited more reliably. In addition, since the occurrence of resonance can be prevented without adjusting the design of the spark plug or the like, a degree of freedom of the design in the spark plug or the like can be sufficiently secured. Furthermore, the conventional spark plug can be used without specifically performing adjustment thereof.

In addition, the capacitance C (F) of the capacitor 46 is set to satisfy $C \geq 0.0005$ (F·Hz)/f with respect to the oscillation frequency f (Hz) of the AC power. Accordingly, the misfire of the AC power is further decreased when the AC power transmits to the capacitor 46, and the ignition ability can be further improved.

In addition, in the embodiment, the permittivity of the insulator 43 is larger than the permittivity of the second insulator 44. Accordingly, a situation such as the AC power input to the capacitor 46 (the AC electrode 42) transmitted to the engine EN of the low potential side via second insulator 44 can reliably be prevented. As a result, the loss of the AC power can be more reliably decreased and the spark can be more effectively grown at the time of transmitting.

In addition, since the insulator 43 is formed of $BaTiO_3$, which is very excellent in terms of the heat resistance and the voltage resistance, the durability of the capacitor 46 can be increased dramatically. As a result, excellent ignition ability can be maintained for longer periods. In addition, since $BaTiO_3$ has extremely high permittivity, the capacitance of the capacitor 46 can be further increased. Accordingly, when the AC power transmits to the capacitor 46, the transmissivity of the AC power can be further improved and the ignition ability can be further improved. Furthermore, in a case where the insulator is formed of the composite material of the ceramic and the resin or the rubber, the resin or the rubber functions as a shock absorber against the mechanical impact or the heat impact, and the durability of the capacitor can be further increased. In addition, the flexibility of the ignition cable 4 is improved and the maneuverability of the ignition cable 4 becomes easy.

Furthermore, the volume resistivity of the discharge electrode 41 and the AC electrode 42 are equal to or less than 0.1 μΩ·m and is formed of the non-magnetic material. Thus, when transmitting, the loss of the AC power can be further decreased and the AC power input to the spark can be further increased. As a result, the ignition ability can be further improved.

Second Embodiment

Figure 6:
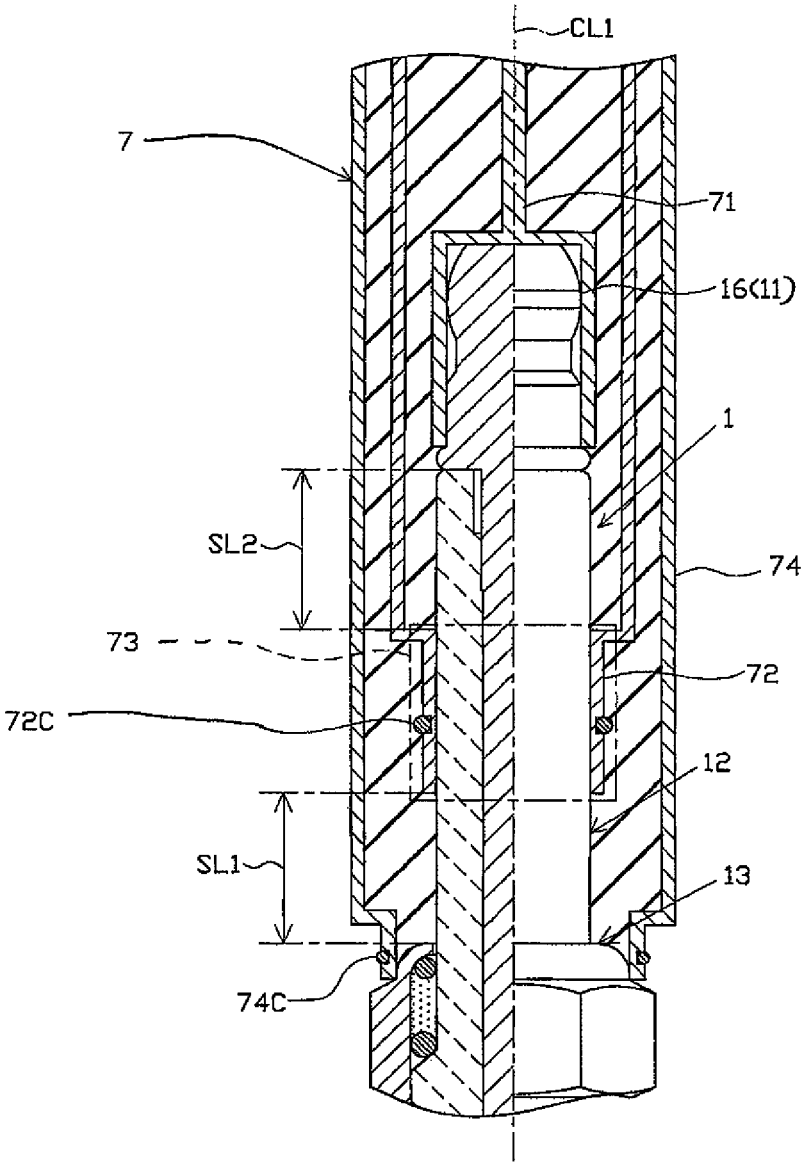
FIG. 6 is a partial cutaway enlarged front view illustrating a configuration of an ignition cable or the like of a second embodiment.

The second embodiment will be described mainly focusing on differences between the first embodiment and the second embodiment. In the above described first embodiment, the ignition cable 4 has the insulator 43. However, in the second embodiment, as shown in FIG. 6, the porcelain insulator 12 included in the spark plug 1 is configured to exhibit the functional equivalent of the insulator 43 in the above described first embodiment.

In other words, in the second embodiment, in a connected state to the spark plug 1, an ignition cable 7 includes a discharge electrode 71 at an end thereof to the spark plug side that is connected to the terminal fitting 16 (the plug electrode 11), and an AC electrode 72 that is arranged at the outer circumference of the porcelain insulator 12 so that an end of the AC electrode 72 to the spark plug side interposes the porcelain insulator 12 with the terminal fitting 16 (the plug electrode 11). Thus, in a state where the ignition cable 7 is connected to the spark plug 1, a capacitor 73 is formed by the plug electrode 11 (the terminal fitting 16), the AC electrode 72 and a portion that is interposed between the plug electrode 11 (the terminal fitting 16) of the porcelain insulator 12. In addition, a facing area of the AC electrode 72 to the plug electrode 11, the thickness of the porcelain insulator 12 or the like is set to satisfy $C \geq 0.0005$ (F·Hz)/f, wherein C (F) is the capacitance of the capacitor 73 and f (Hz) is the oscillation frequency of the AC power.

In addition, in the second embodiment, a relative position of the AC electrode 72 with respect to the spark plug 1 is set when the ignition cable 7 is mounted on the spark plug 1 so that a shortest distance SL1 between the AC electrode 72 and the main metal fitting 13 along the surface of the porcelain insulator 12 and a shortest distance SL2 between the AC electrode 72 and the plug electrode 11 (the terminal fitting 16) along the surface of the porcelain insulator 12 are both equal to or greater than 5 mm.

Furthermore, at the end of the AC electrode 72 to the spark plug side, a circular connector spring 72C is disposed as a fastener. Accordingly, in a state where the ignition cable 7 is connected to the spark plug 1, the AC electrode 72 allows the porcelain insulator 12 to fasten in the radial direction. In addition, at the end of the shield member 74 of the ignition cable 7 to the spark plug side, a circular connector spring 74C is also disposed, and in a state where the ignition cable 7 is connected to the spark plug 1, the shield member 74 allows the main metal fitting 13 to fasten in the radial direction.

In addition, the porcelain insulator 12 is formed of the insulating ceramic (for example, $BaTiO_3$, $PbTiO_3$, $Al_2O_3$ or the like). In addition, similar to the first embodiment, the volume resistivity of the facing portion of the discharge electrode 71 and the AC electrode 72 that interposes the porcelain insulator 12 is equal to or less than 0.1 μΩ·m and is configured of the non-magnetic material (for example, Cu, Ag, Au, Al, Zn or an alloy having any one of the foregoing as a main component thereof).

As described above, according to the second embodiment, basically the same effects as the first embodiment can be accomplished.

In addition, since the capacitor 73 is formed by using the porcelain insulator 12 included in the spark plug 1 generally, the manufacturing cost thereof can be effectively decreased compared to the case where the capacitor is disposed at the ignition cable.

Furthermore, since a connector spring 72A is disposed at the end of the AC electrode 72 to the spark plug 1 side, the porcelain insulator 12 and the AC electrode 72 can be more stably formed. As a result, the capacitor 73 can be more reliably formed by the plug electrode 11, the porcelain insulator 12 and the AC electrode 72.

In addition, the shortest distance SL1 between the AC electrode 72 and the main metal fitting 13 along the surface of the porcelain insulator 12 and the shortest distance SL2 between the AC electrode 72 and the plug electrode 11 (the terminal fitting 16) along the surface of the porcelain insulator 12 are made large enough so as to be equal or greater than 5 mm respectively. Accordingly, the leakage of current between the AC electrode 72 and the main metal fitting 13 or the terminal fitting 16 can be more reliably prevented. Furthermore, the creation of the misfire can be more effectively suppressed.

Figure 7:
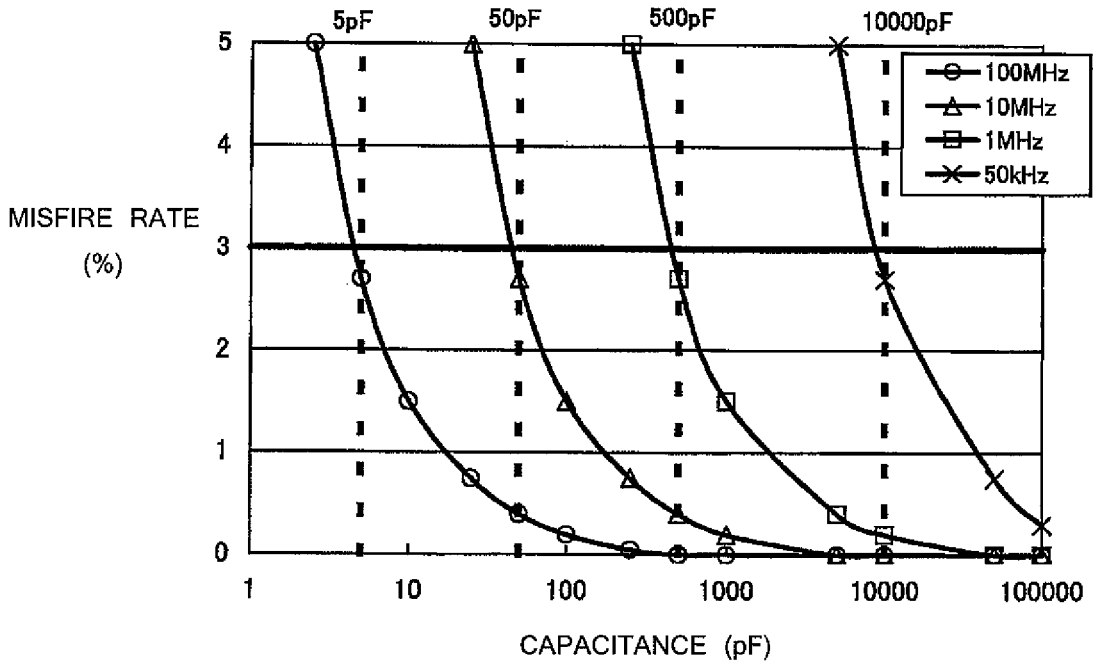
FIG. 7 is a graph illustrating a test result of an evaluation of the ignition ability in samples where a capacitance of a capacitor is changed.

Next, in order to confirm the effect that is exhibited by the above described embodiments, samples of the ignition system are prepared where the capacitance of the capacitor is varied and an evaluation test of the ignition ability is performed with each of the samples. An outline of the evaluation test of the ignition ability is provided below. In other words, the spark plug of each of the samples is mounted on a DOHC 4-cylinder engine having a displacement volume of 2000 cc and the air fuel ratio (A/F) is set to 17. The power of the AC power supply is 300 W and then an original frequency of the AC power is changed to 100 MHz, 10 MHz, 1 MHz and 50 kHz and the power is input to each of the samples 1000 times. The number of times a misfire (the abnormal discharge) is generated in 1000 times is measured and the creation ratio of the misfires (the misfire rate) is computed. The test result of the test is illustrated in FIG. 7. In FIG. 7, the test results are indicated with circles when the original frequency is 100

MHz and the test results are indicated with triangles when the original frequency is 10 MHz. In addition, the test results are indicated with squares when the original frequency is 1 MHz and the test results are indicated with cross marks when the original frequency is 50 kHz.

As shown in FIG. 7, in a case where the original frequency is 100 MHz, the capacitance of the capacitor is equal to or more than 5 pF, in a case where the original frequency is 10 MHz, the capacitance of the capacitor is equal to or more than 50 pF, in a case where the original frequency is 1 MHz, the capacitance of the capacitor is equal to or more than 500 pF, and in a case where the original frequency is 50 kHz, the capacitance of the capacitor is equal to or more than 10000 pF. In other words, the capacitance or the like of the capacitor is set to satisfy $C \geq 0.0005$ (F·Hz)/f, wherein f (Hz) is the original frequency and C (F) is the capacitance of the capacitor so that it is revealed that the misfire rate is less than 3% and the excellent ignition ability can be realized. It is considered because the capacitance of the capacitor is increased so that the AC power is more reliably transmitted into the capacitor and then the AC power is more reliably input to the spark.

According to the above described test result, it is preferable that the capacitance or the like of the capacitor be set to improve the ignition ability and to satisfy $C \geq 0.0005$ (F·Hz)/f.

Figure 8:
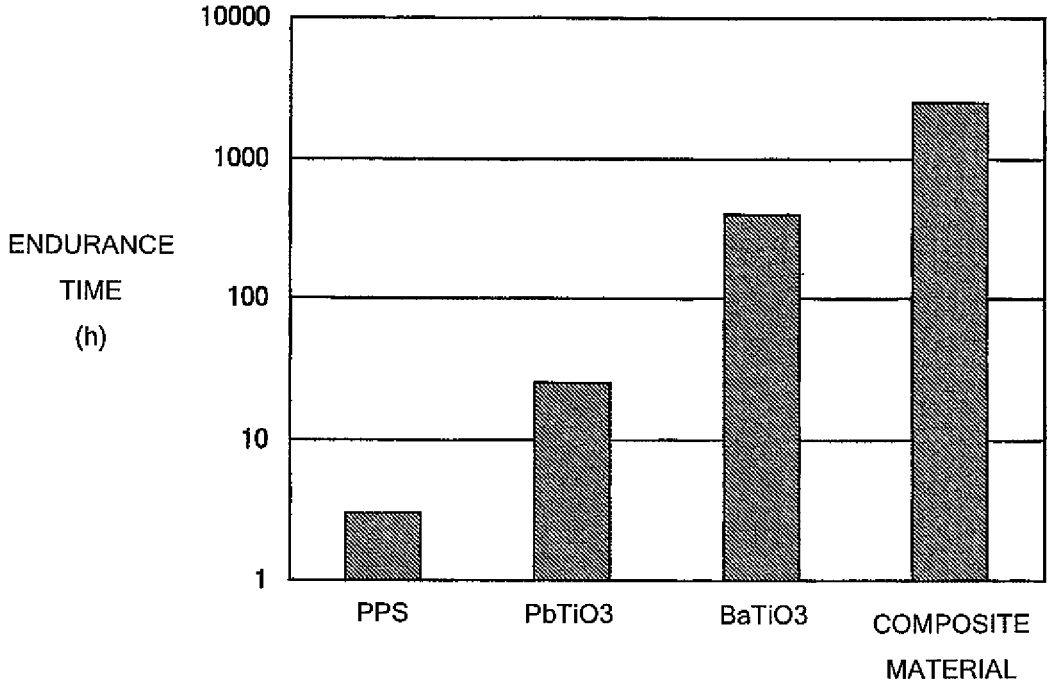
FIG. 8 is a graph illustrating a test result of an evaluation of the durability in samples where a configuration material of an insulator is changed.

Next, samples of the ignition system are prepared where the insulator is formed of polyphenylene sulfide resin (PPS), lead titanate ($PbTiO_3$), barium titanate ($BaTiO_3$), or the composite material of $BatiO_3$ and silicon rubber (Si rubber) and an evaluation test of the durability (i.e., an endurance test) is performed for each of the samples. An outline of the evaluation test of the durability is provided below. In other words, the spark plug of each of the samples is mounted on a DOHC 4-cylinder engine having a displacement volume of 2000 cc, and the test is performed during which the engine is repeatedly driven in full opened state (=4000 rpm) for 30 minutes, and then in idling state for 30 minutes, and a time is measured (an endurance time) until a perforation is generated at the portion interposed between the discharge electrode and the AC electrode of the insulator (in other words, the portion where the capacitor is formed). The test result of the test is illustrated in FIG. 8. In addition, the capacitance of the capacitor is 200 pF in each of the samples. In addition, the output power of the AC power source is 300 W and the oscillation frequency of the AC power is 50 MHz.

As shown in FIG. 8, the sample, where the insulator is formed of the ceramic ($PbTiO_3$ or $BaTiO_3$) or the composite material having excellent heat resistance, has excellent durability and specifically the endurance time of the sample, where the insulator is formed of $BaTiO_3$, is about 400 hours which confirms that the sample has very excellent durability.

In addition, the endurance time of the sample, where the insulator is formed of the composite material of the ceramic and the rubber, is over 1000 hours and this confirms that the sample has very excellent durability. It is considered because the rubber functions as the shock absorber with respect to the vibration or the heat expansion of the electrode, and the strength of the capacitor is improved with respect to the mechanical impact or the heat impact. In the above described test, the test is performed using the composite material formed of the ceramic and the rubber. However, in a case where the resin is used instead of the rubber, the same result may be obtained.

According to the above described test result, in order to improve the durability, it is preferable that the insulator be formed of the ceramic and specifically, it is more preferable that the insulator be formed of $BatiO_3$ or the composite material of the ceramic, the rubber or the like.

Figure 9:
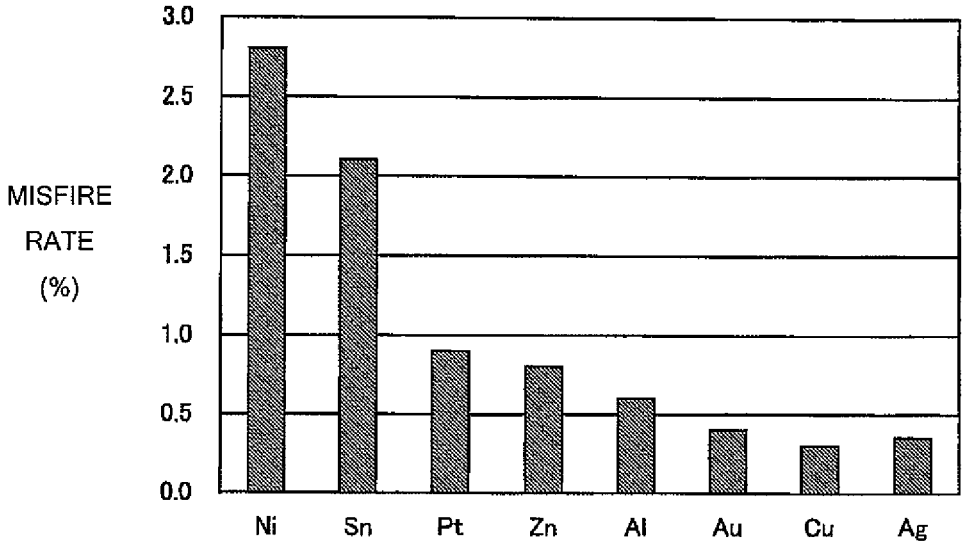
FIG. 9 is a graph illustrating a test result of an evaluation of the ignition ability in samples where a configuration material of portions of a discharge electrode and an AC electrode which face each other by interposing an insulator is changed.

Next, samples of the ignition system are prepared where the constitutional metal of portions of the discharge electrode and the AC electrode facing each other by interposing the insulator is changed variously and the evaluation test of the ignition ability is performed to each of the samples. The test result of the test is illustrated in FIG. 9. In addition, presence or absence of the volume resistivity and the magnetism are shown in Table 1. The capacitance of the capacitor and the original frequency of the AC power are set to satisfy $C \geq 0.0005$ (F·Hz)/f.

TABLE 1

| | Metallic material | | | | | | | |
|---|---|---|---|---|---|---|---|---|
| | Ni | Sn | Pt | Zn | Al | Au | Cu | Ag |
| Volume resistivity (μΩ · m) | 0.07 | 0.11 | 0.10 | 0.06 | 0.028 | 0.024 | 0.017 | 0.016 |
| Magnetism | Present | Absent | Absent | Absence | Absent | Absent | Absent | Absent |

As shown in FIG. 9, and Table 1, it is revealed that each of the samples has the misfire rate of less than 3% and excellent ignition ability, and specifically the volume resistivity is equal to or less than 0.10 μΩ·m. In addition, the sample using the metal having no magnetism has less than 1.0% in the misfire rate and excellent ignition ability. It is considered that when transmitting, the loss of the AC power is suppressed and the AC power input to the spark is increased.

In addition, specifically, it is confirmed that the sample using Cu, Ag, Au, Al or Zn as the metallic material can realize the excellent ignition ability.

According to the above described test result, in order to improve the ignition ability, it is preferable that at least portions of the discharge electrode and the AC electrode facing each other by interposing the insulator have the volume resistivity less than 0.1 μΩ·m and are formed of the non-magnetic material. In addition, to the point of realizing improved ignition ability, it is more preferable that Cu, Ag or the like having relatively low volume resistivity, or a metal having any one of the foregoing is used as the main component.

Next, in the ignition system corresponding to the above described second embodiment, samples of the ignition system are prepared where the shortest distances between the AC electrode and the terminal fitting along the outer surface of the porcelain insulator are changed variously. In addition, the voltage (the voltage of the discharge power source) that is applied to the discharge electrode in each of the samples is gradually increased, and the discharge voltage is measured when there is leakage of the current between the AC electrode and the terminal fitting. The test result of the test is illustrated in FIG. 10.

Figure 10:
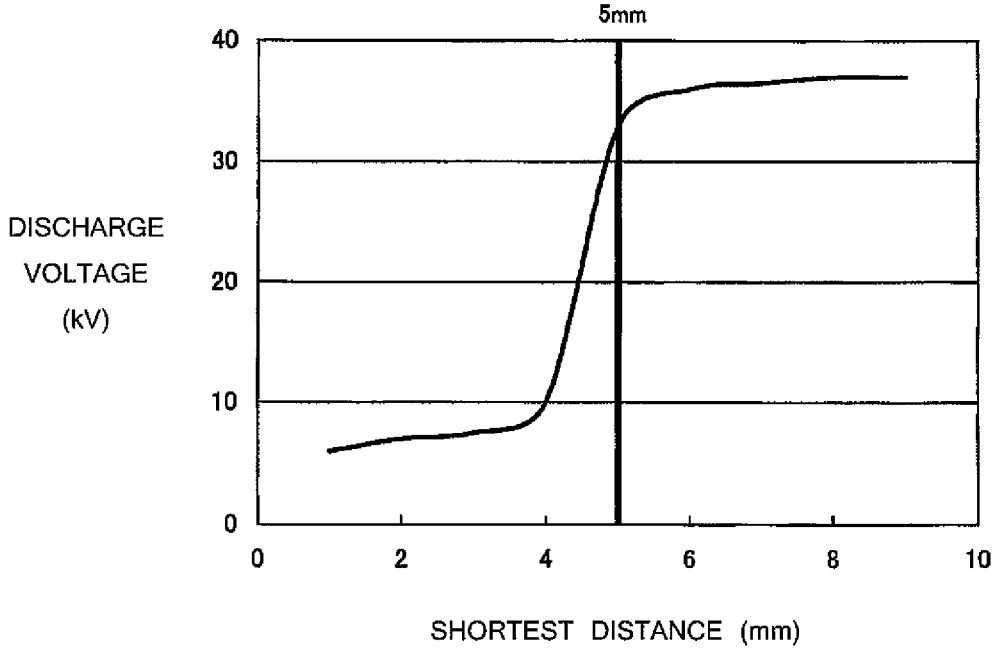
FIG. 10 is a graph illustrating a relationship between the shortest distance between an AC electrode and a terminal fitting, and a discharge voltage when leakage of the current between the AC electrode and the terminal fitting occurs.

As shown in FIG. 10, it is confirmed that in the sample where the shortest distance thereof is equal to or greater than 5 mm, the discharge voltage is equal to or greater than 30 kV and the leakage of the current is very unlikely to occur.

According to the above described test result, in order to prevent the leakage of the current, it is preferable that the shortest distance be equal to or more than 5 mm. In addition, also in the shortest distance between the AC electrode and the main metal fitting along the outer surface of the porcelain insulator, in order to prevent the leakage of the current between both members, it is preferable that the shortest distance be equal to or more than 5 mm.

In addition, the invention is not limited to the above described embodiments, and for example, may be performed as below. Of course, other applications and modified examples that are not illustrated are possible to perform as below.

Figure 11:
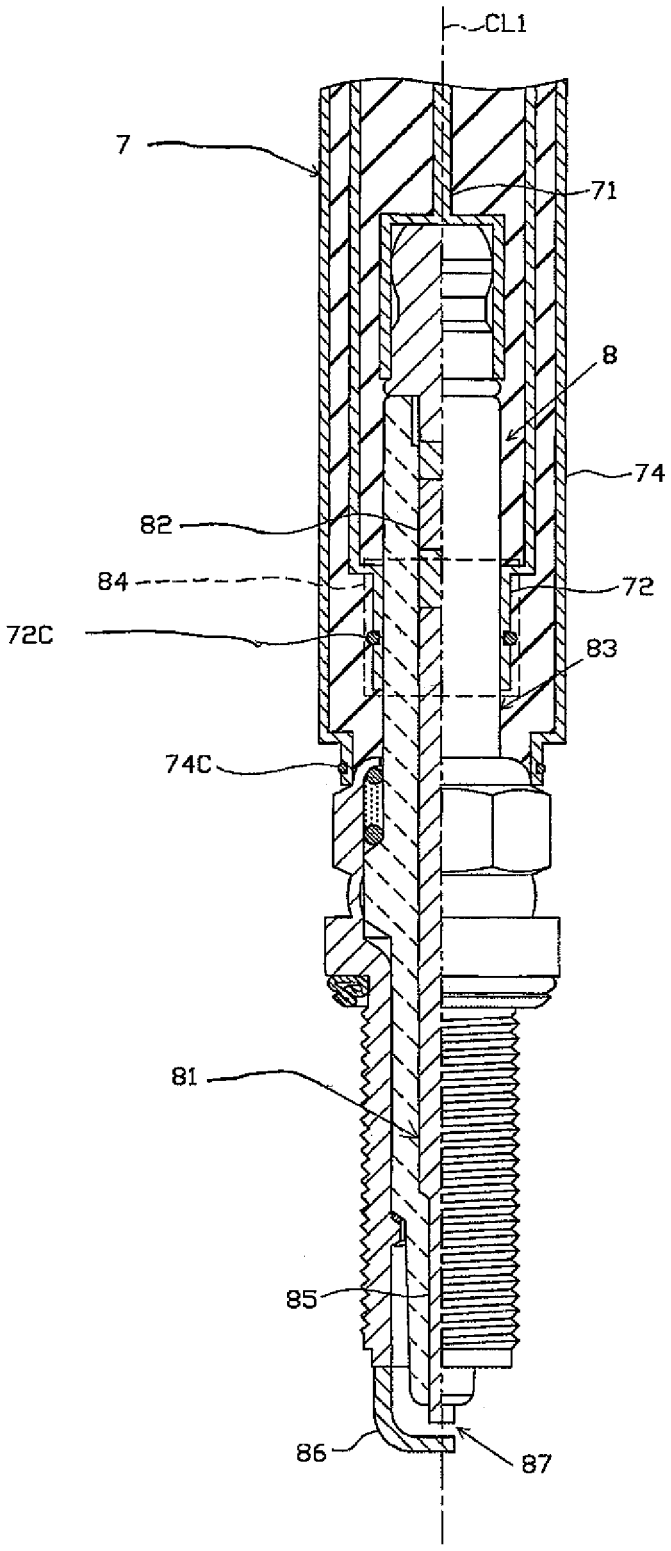
FIG. 11 is a partial cutaway front view illustrating a configuration of a spark plug or the like of another embodiment.

(a) In the above described second embodiment, the plug electrode 11 is configured of the center electrode 15, the terminal fitting 16, and the glass seal layer 18. However, in order to suppress the radio noise, as shown in FIG. 11, a resistor 82 (for example, that is firing the resistor composition including conductive material and the glass powder) may be inserted into a plug electrode 81. In addition, for disposing the resistor 82, in a state where the ignition cable 7 is connected to the spark plug 8, it is preferable that a capacitor 84, which is configured of a portion interposed between both of the AC electrode 72, the plug electrode 81 and the porcelain insulator 83, be provided at the tip (in other words, to a gap 87 formed between a center electrode 85 and a ground electrode 86) of the spark plug 1 than at the resistor 82. In this case, since the resistor 82 is present only at a conductive path of the voltage from the discharge power source 2, and the resistor 82 is not present at a conductive path of the AC power, the loss of the AC power due to the resistor 82 can be prevented and the effect of the improving of the ignition ability can be more reliably exhibited.

Figure 12:
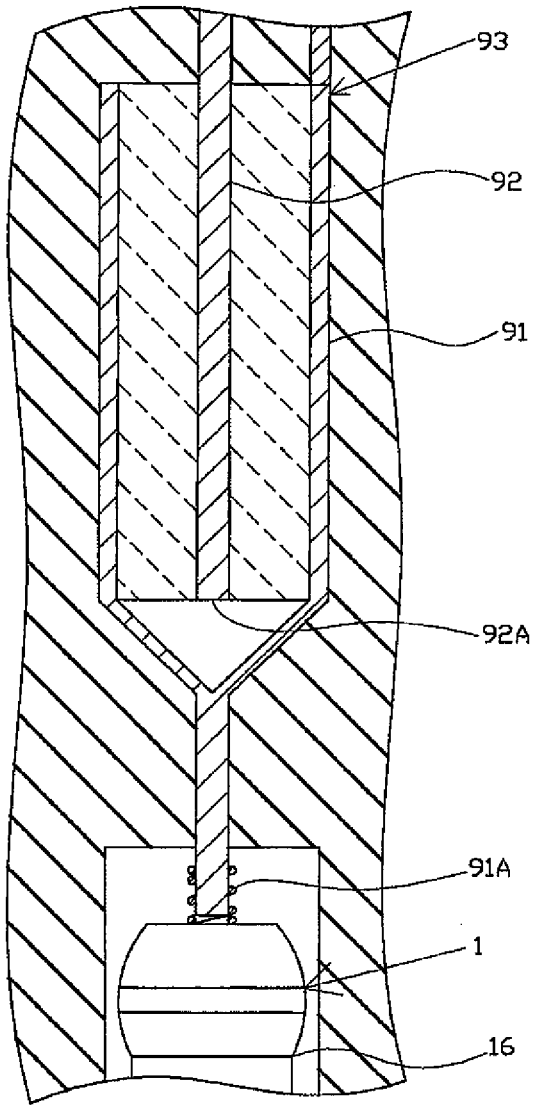
FIG. 12 is a partially enlarged cross-sectional view illustrating a configuration of a capacitor of another embodiment.

(b) In the first embodiment, the capacitor 46 is configured such that the cylindrical shaped AC electrode 42 is disposed at the outer circumference of the discharge electrode 41. However, the configuration of the capacitor is not limited to the embodiment. Accordingly, for example, as shown in FIG. 12, a capacitor 93 may be used in which a discharge electrode 91 is arranged at the outer circumference thereof, and an AC electrode 92 is arranged at the inner circumference thereof (in other words, the positions of both electrodes are replaced). In addition, in this case, an end 91A of the discharge electrode 91 to the spark plug is positioned to a side of the spark plug 1 than an end 92A of the AC electrode 92 to the spark plug, and the end 91A of the discharge electrode 91 to the spark plug is connected to the spark plug 1.

Figure 13:
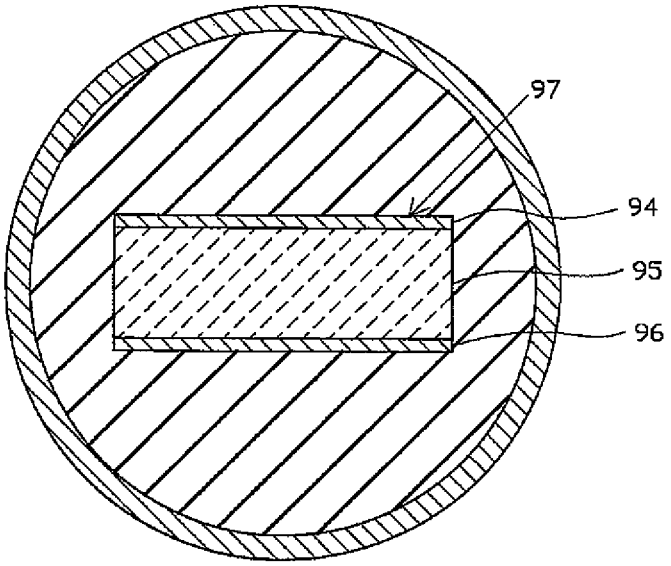
FIG. 13 is a partially enlarged cross-sectional view illustrating a configuration of a capacitor of yet another embodiment.
Figure 14:
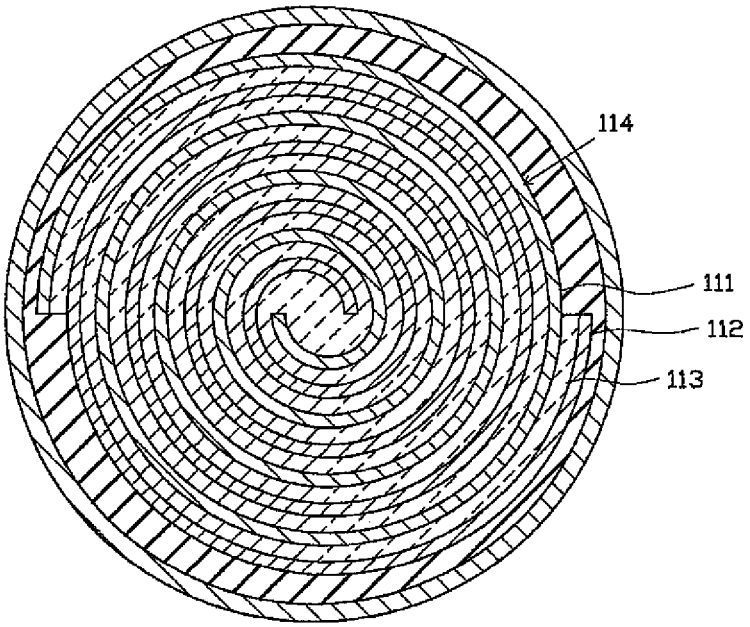
FIG. 14 is a partially enlarged cross-sectional view illustrating a configuration of a capacitor of yet another embodiment.

In addition, as shown in FIG. 13, a capacitor 97 may be used in which a plane-shaped discharge electrode 94 faces a plane-shaped AC electrode 96 with an insulator 95 interposed therebetween. Furthermore, as shown in FIG. 14, in the cross section orthogonal to the ignition cable in the longitudinal direction, a capacitor 114 may be used. The capacitor 114 includes a discharge electrode 111 at least a portion thereof forming a spiral; an AC electrode 112 at least a portion thereof forming a spiral which faces the spiral-shaped portion of the discharge electrode 111; and an insulator 113 that is arranged between the spiral-shaped portion of the discharge electrode 111 and the spiral-shaped portion of the AC electrode 112. In addition, the spiral-shaped portion of the discharge electrode 111 or the AC electrode 112 is extended along the longitudinal direction of the ignition cable so that the facing areas of both electrodes 111 and 112 can be largely secured and the capacitance of the capacitor 114 can be easily increased.

Figure 15:
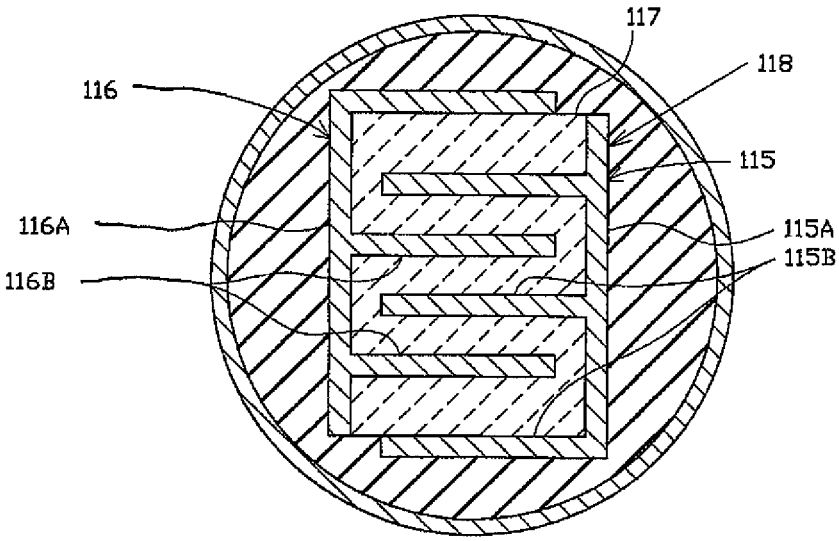
FIG. 15 is a partially enlarged cross-sectional view illustrating a configuration of a capacitor of yet another embodiment.

As shown in FIG. 15, a capacitor 118 may be used. The capacitor 118 includes a discharge electrode 115; an AC electrode 116 that is extended along the longitudinal direction of the discharge electrode 115 (in other words, electrodes 115 and 116 form comb-tooth shapes respectively); and an insulator 117 that is arranged between both a first auxiliary electrode plate 115B and a second auxiliary electrode plate 116B. The discharge electrode 115 includes a first main electrode plate 115A, and a plurality of the first auxiliary electrode plates 115B that extend from the first main electrode plate 115A and line up along a direction orthogonal to the longitudinal direction of the first main electrode plate 115A. The AC electrode 116 includes a second main electrode plate 116A that faces the first main electrode plate 115A, and a plurality of the second auxiliary electrode plates 116B that extend from the second main electrode plate 116A and line up alternately with the first auxiliary electrode plate 115B along a direction orthogonal to the longitudinal direction of the second main electrode plate 116A.

In addition, the capacitors 97,114 and 118 may be configured so as to be arranged at the inner circumference of the cylindrical shaped second insulator. In this case, it is preferable that the permittivity of the insulator be larger than that of the second insulator.

(c) In the above described embodiments, the power is supplied from the discharge power source 2 or the AC power source 3 to each spark plug 1 via a distributor. However, the discharge power source 2 or the AC power source 3 may be disposed at every spark plug 1.

DESCRIPTION OF REFERENCE NUMERALS AND SIGNS

1: spark plug
2: discharge power source
3: AC power source
4: ignition cable
11, 81: plug electrode
41: discharge electrode
42: AC electrode
43: insulator
44: second insulator
72C: connector spring (fastener)
82: resistor
115A: first main electrode plate
115B: first auxiliary electrode plate
116A: second main electrode plate
116B: second auxiliary electrode plate
CL1: axis Having described the invention, the following is claimed:

1. An ignition system comprising:

a spark plug;

a discharge power source applying a voltage in order to generate a spark discharge at the spark plug;

an AC power source supplying AC power to a spark generated by the spark discharge; and an ignition cable electrically connecting the spark plug, the discharge power source and the AC power source, wherein the ignition cable includes, a discharge electrode connecting the discharge power source and the spark plug in order to apply the voltage from the discharge power source to the spark plug, an AC electrode transmitting the AC power from the AC power source to the spark plug side, an insulator interposed between the discharge electrode and the AC electrode, and a cylindrical shaped second insulator, wherein at least a portion of the second insulator is arranged to surround at least a portion of an outer circumference of the discharge electrode, the AC electrode and the insulator, and wherein a permittivity of the insulator is larger than a permittivity of the second insulator, and wherein the ignition cable is configured, such that the AC electrode is cylindrical shaped and is arranged at an inner circumference of the second insulator, the insulator is cylindrical shaped and is arranged at an inner circumference of the AC electrode, the discharge electrode is arranged at an inner circumference of the insulator, and an end of the discharge electrode is at the spark plug side and is connected to the spark plug.

2. The ignition system according to claim 1, wherein an oscillation frequency of the AC power is equal to or more than 50 kHz and equal to or less than 100 MHz, wherein when a capacitance of a capacitor formed of the discharge electrode, the AC electrode and the insulator is C (F), and the oscillation frequency of the AC power is f (Hz), $C \geq 0.0005$ (F·Hz)/f is satisfied.

3. The ignition system according to claim 1, wherein the insulator is formed of a composite material of a ceramic, and a resin or a rubber.

4. The ignition system according to claim 1, wherein the ignition cable is configured, such that the discharge electrode, at least a portion thereof is cylindrical, is arranged at the inner circumference of the second insulator, the insulator is cylindrical and is arranged at an inner circumference of the cylindrical portion of the discharge electrode, the AC electrode is arranged at the inner circumference of the insulator, and an end of the discharge electrode to the spark plug side is connected to the spark plug.

5. The ignition system according to claim 1, wherein the ignition cable is configured, such that at least of a portion of the discharge electrode is plane-shaped, a portion of the AC electrode which faces at least the plane-shaped portion of the discharge electrode is plane-shaped, the insulator is arranged between the plane-shaped portion of the discharge electrode and the plane-shaped portion of the AC electrode, both electrodes and the insulator are arranged at the inner circumference of the second insulator, and an end of the discharge electrode to the spark plug side is connected to the spark plug.

6. The ignition system according to claim 1, wherein the ignition cable is configured, such that at least a portion of the discharge electrode is spiral-shaped at a cross-section orthogonal to a longitudinal direction thereof, a portion of the AC electrode which faces at least the spiral-shaped portion of the discharge electrode is spiral-shaped, the insulator is arranged between the spiral-shaped portion of the discharge electrode and the spiral-shaped portion of the AC electrode, the discharge electrode, the AC electrode and the insulator are arranged at the inner circumference of the second insulator, and an end of the discharge electrode to the spark plug side is connected to the spark plug.

7. The ignition system according to claim 1, wherein the ignition cable is configured, such that the discharge electrode includes a first main electrode plate extending along the longitudinal direction thereof and a plurality of first auxiliary electrode plates extending from the first main electrode plate and lined up along a direction orthogonal to the longitudinal direction, the AC electrode includes a second main electrode plate extending along the longitudinal direction thereof and a plurality of second auxiliary electrode plates extending from the second main electrode plate and lined up along a direction orthogonal to the longitudinal direction, the discharge electrode and the AC electrode are arranged so that the first main electrode plate and the second main electrode plate face each other, and the first auxiliary electrode plates and the second auxiliary electrode plates are lined up alternately, the insulator is arranged between both auxiliary electrode plates, the discharge electrode, the AC electrode and the insulator are arranged at the inner circumference of the second insulator, and the end of the discharge electrode to the spark plug side is connected to the spark plug.

8. The ignition system according to claim 1, wherein the insulator is formed of a ceramic.

9. The ignition system according to claim 8, wherein the ceramic has barium titanate as a main component.

10. The ignition system according to claim 1, wherein at least portions of the discharge electrode and the AC electrode that face each other by interposing the insulator have a volume resistivity equal to or less than 0.1 μΩ·m and are formed of a non-magnetic metallic material.

11. The ignition system according to claim 10, wherein the metallic material is copper, silver, gold, aluminum, zinc or an alloy of which any one of the foregoing is a main component.

12. An ignition system comprising:

a spark plug;

a discharge power source applying a voltage in order to generate a spark discharge at the spark plug;

an AC power source supplying the AC power to a spark generated by the spark discharge; and an ignition cable electrically connecting the spark plug, the discharge power source and the AC power source, wherein the spark plug has an insulator having a shaft hole extending in an axial direction, a plug electrode arranged inside the shaft hole and in which a voltage is applied from the discharge power source and a main metal fitting arranged at an outer circumference of the insulator, wherein the ignition cable includes, a discharge electrode transmitting the voltage from the discharge power source, and an AC electrode arranged to surround at least a portion of an outer circumference of the discharge electrode and supplying the AC power from the AC power source to the spark plug, and wherein in a state where the ignition cable is connected to the spark plug, an end of the discharge electrode to the spark plug side is connected to the plug electrode, an end of the AC electrode to the spark plug side is arranged to surround at least a portion of the outer circumference of the insulator of the spark plug so as to interpose the insulator between the plug electrode and the AC electrode, and the shortest distance between the AC electrode and the main metal fitting along the surface of the insulator, and the shortest distance between the AC electrode and the plug electrode along the surface of the insulator are equal to or more than 5 mm respectively, wherein the ignition cable is configured, such that the AC electrode is cylindrical shaped and is arranged at an inner circumference of the second insulator, the insulator is cylindrical shaped and is arranged at an inner circumference of the AC electrode, the discharge electrode is arranged at an inner circumference of the insulator, and an end of the discharge electrode is at the spark plug side and is connected to the spark plug.

13. The ignition system according to claim 12, wherein an oscillation frequency of the AC power is equal to or more than 50 kHz and equal to or less than 100 MHz, and wherein when the capacitance of a capacitor formed by the plug electrode, the AC electrode and the insulator interposed between the plug electrode and the AC electrode is C (F), and the oscillation frequency of the AC power is f (Hz), $C \geq 0.0005$ (F·Hz)/f is satisfied.

14. The ignition system according to claim 12, wherein in a state where the ignition cable is connected to the spark plug, a fastener, which can fasten the insulator in the radial direction, is disposed at the end of the AC electrode to the spark plug side.

15. The ignition system according to claim 12, wherein the spark plug includes a conductive resistor on a transmission path of the voltage from the discharge power source, and wherein in a state where the ignition cable is connected to the spark plug, the capacitor, which is formed of the plug electrode, the AC electrode, and the insulator interposed between the plug electrode and the AC electrode, is formed at a tip side of the spark plug than the conductive resistor.

16. The ignition system according to claim 12, wherein the insulator has barium titanate as a main component.

17. The ignition system according to claim 12, wherein at least portions of the plug electrode and the AC electrode that face each other by interposing the insulator have a volume resistivity equal to or less than 0.1 μΩ·m and are formed of a non-magnetic metallic material.

18. The ignition system according to claim 17, wherein the metallic material is copper, silver, gold, aluminum, zinc or an alloy of which any one of the foregoing is a main component.

19. The ignition system according to claim 3, wherein the ceramic has barium titanate as a main component.

* * * * *